United States Patent [19]

Tsuihiji et al.

[11] Patent Number: 5,031,413

[45] Date of Patent: Jul. 16, 1991

[54] LOW-TEMPERATURE FOODS PRESERVING CASE AND ITS TEMPERATURE CONTROL METHOD

[75] Inventors: Shunichi Tsuihiji; Hideaki Furutachi; Mitsuru Kakinuma, all of Gunma, Japan

[73] Assignee: Sanyo Electric Co., Ltd., Osaka, Japan

[21] Appl. No.: 278,666

[22] Filed: Dec. 1, 1988

[30] Foreign Application Priority Data

Jan. 20, 1988 [JP] Japan ..... 63-8415

[51] Int. Cl.[5] ..... F25D 21/06; F25B 5/02

[52] U.S. Cl. ..... 62/234; 62/155; 62/156; 62/127; 62/199; 62/274; 62/282

[58] Field of Search ..... 62/199, 200, 275, 152, 62/156, 155, 282, 274, 126, 129, 127, 130, 229, 231, 234, 157, 272; 236/46 F

[56] References Cited

U.S. PATENT DOCUMENTS

| | | | |
|---|---|---|---|
| 3,103,796 | 9/1963 | Dickson et al. | 62/234 |
| 4,122,892 | 10/1978 | Delaporte | 62/199 X |
| 4,381,549 | 4/1983 | Stamp, Jr. et al. | 62/126 |
| 4,530,217 | 7/1985 | Alluto et al. | 62/156 |
| 4,664,182 | 5/1987 | Miwa | 62/272 |
| 4,691,527 | 9/1987 | Ikeda | 62/234 |
| 4,723,414 | 2/1988 | Hurutachi et al. | 62/199 X |
| 4,821,528 | 4/1989 | Tershak | 62/126 X |

FOREIGN PATENT DOCUMENTS

| | | |
|---|---|---|
| 629511 | 8/1980 | Japan . |
| 629670 | 11/1983 | Japan . |
| 6216601 | 4/1987 | Japan . |

*Primary Examiner*—Harry B. Tanner
*Attorney, Agent, or Firm*—Darby & Darby

[57] ABSTRACT

A low-temperature foods preserving case and a temperature control method therefor, in which a plurality of evaporators, each partitioned by partitioning panels, are arranged correctively in a cooling chamber, for which sequential cooling and defrosting operations are instructed by a timer, so that circulatory passage of the cooling air is formed through said cooling chamber, the foods preserving chamber, and the cooling chamber by means of fans installed in each of partitioned air passages separated by said partitioning panels.

11 Claims, 8 Drawing Sheets

FIRST EVAPORATOR
COMPRESSOR ON
COMPRESSOR OFF
SOLENOID VALVES A "ON"
SOLENOID VALVES A "OFF"

LOW-TEMPERATURE FOODS PRESERVING CASE AND ITS TEMPERATURE CONTROL METHOD

FIELD OF THE INVENTION

The invention pertains to a low-temperature foods preserving case suitable for displaying or preserving cakes and the like, and its temperature control method.

BACKGROUND OF THE INVENTION

In preserving fresh foods such as cakes, meat, vegetables, and fruits at low-temperature in a case appropriate humidity is required inside the case so that the air therein is not only too dry but also, in the case of preservation of cakes in particular, not too humid. In view of these points there has been proposed a low-temperature foods preserving case having two evaporators and a fan in the passage of the cooling air, and is capable of maintaining high humidity inside the case by operating the evaporators alternately by means of a timer in such a way that, while one of the evaporator is in operation, the other evaporator is stopped to permit the defrosted water collected therefrom into a reservoir to evaporate (Japanese Utility Publication 62-9511).

However, since the above conventional case has two evaporators arranged at up and down bi-levels in the case, so that, after being circulated half way round the air route of the air circulated by the fan in the case, the humidity contained in the air tends to condense and gets deposited on the cooling evaporator which is evaporating the refrigerant. Consequently, the cooling air passed through the evaporator loses its humidity and has a poor humidification in the later half of the air circulation route.

Further, since the defrosted water is left in the reservoir for natural evaporation, the surface area of the water in contact with the air is small, and since the temperature of the water is too low for good evaporation, the the natural evaporation is not great and difficult to maintain high humidity inside the case as required.

There is a proposition on the use of an electric heater for heating the two evaporators for facilitating good evaporation of the water deposited on one of the evaporators which is stopped for defrosting operation in the alternate stopping and running cycle controlled by a timer provided in the case. See, for example, Japanese Patent Application Laid Open 62-9670.

This prior art heating is controlled by the timer for turns ON the heater and by a temperature detector which turns OFF the heater as the temperature reaches a predetermined temperature. Incidentally, the defrosting period of time during which one of the two evaporators is stopped for defrosting operation under said timer control, is obviously set longer than the heating period.

Therefore, the conventional defrosting operation of the evaporator is carried out intensively over a short time interval in the first half of the predetermined defrosting period started by the timer. During this period most of the water deposited on the defrosting evaporator is evaporated, but is again condensed on the cooling evaporator. The evaporation of the water from the defrosting evaporator drops sharply thereafter. Thus, the conventional system has a disadvantage that the water is not evaporated evenly during the defrosting period, so that the humidification inside the case by means of the defrosted water is not obtained as desired.

Also in such a conventional case, temperature sensors provided at various positions each have their own definite roles, so that a temperature control sensor that has failed to function cannot be backed up by other sensors, resulting in the malfunction of the temperature control system as a whole.

In order to maintain a preferable temperature inside such a conventional case even in the event of the malfunction of the temperature control system, a ON-OFF switching of the cooling apparatus by means of a timer has been proposed, as described in Japanese Utility Publication 62-16601.

Hoverer, this conventional system requires tedious adjustment of the duty cycle of the temperature control system so as to meet the environmental conditions every time the system has failed, since the setting of ON and OFF duty periods is not automatically adjusted.

BRIEF SUMMARY OF THE INVENTION

The invention is directed to overcome aforementioned disadvantages associated with conventional art. The major object of the invention is to provide a low-temperature foods preserving case which is capable of providing optimum humidity by suitably humidifying inside the case.

Another object of the invention is to provide a very reliable temperature control method for such a low-temperature foods preserving case, which enables the case to maintain its function without being affected by the malfunction of the temperature control sensor thereof.

A still further object of the invention is to provide a temperature control method for such a low-temperature foods preserving case, which enables the temperature control system to automatically set the ON and OFF duty periods of the evaporators in accordance with the temperature of the surroundings.

For carrying out these objects the low-temperature foods preserving case in accordance with the invention, constituted to sequentially proceed cooling and defrosting operations, comprises: a plurality of evaporators arranged collectively at a location in the cooling chamber and connected in parallel with each other for alternate cooling and defrosting operations; partition panels each arranged between said evaporators for partitioning said cooling chamber for a corresponding evaporator; a blower or fan for generating in the cooling chamber forced circulation of air sent from the foods preserving chamber back to the cooling chamber.

With this constitution, since the plurality of the evaporators, separated by the partition panels, are collectively located at one position, the water vapor evaporated from the defrosting evaporator is circulated through the case as it is carried by the air stream generated by the fan. In this circulation most of the vapor is conserved inside the case. Furthermore, although a portion of the vapor is deposited on the cooling evaporator after a circulation, remaining portion again passes through the defrosting evaporator. Because of this the humidification inside the case is better performed than the conventional one, giving optimum humidity therein.

In order to make the defrosting perfect, the evaporators are preferably provided with defrosting heater means for enhanced heating prior to the end of the defrosting period of the cycle (the period during which the cooling operation of an evaporator is stopped), and completing the defrosting before the subsequent cooling operation.

It is then possible to gradually and evenly evaporate in the air the frost or dews on the evaporator during the forced air circulation in the first half of the defrosting cycle. Towards the end of the defrosting period the frost that has remained on the evaporator is eventually evaporated completely, thereby bringing the system to a favorable condition for cooling.

If, however, this heating means is operated in the first half of the defrosting period as in conventional systems the frost deposited on the evaporator will be evaporated at a time, resulting in undesirable over-humidification of the air in the case, and again deposited on the cooling evaporator, as mentioned before.

It is preferable to provide the evaporator surface with a coat of paint which enhances water adhesion property.

The coat helps the water deposited thereon widely spread on the surface of the evaporator, increasing the evaporating area of the frost and hence the rate of humidification in defrosting period.

The fan mentioned above is arranged in association with each of the evaporators and preferably operated continuously. This makes about constant the amount of the cooling air passing through the cooling evaporator and of the humidifying air passing through the defrosting evaporator, providing the predetermined cooling and humidifying effects.

Next, the temperature control method according to the invention for the low-temperature foods preserving case comprises control of sequential refigeration and defrosting governed by a timer and ON-OFF temperature control of the compressor based on the comparison of the temperature of the cooling evaporator with the temperature detected by a temperature control sensor, and is characterized by:

means of finding malfunction of the temperature control sensor:

means of providing temperature control, in an event of said malfunction, using the detection signal from another temperature sensor installed in the case;

means of indicating the malfunction.

In this constitution, should the temperature control sensor inside the low-temperature foods-preserving case fail to operate, the case would be maintained in a normal operating condition to keep the temperature inside the case at a predetermined temperature, and the malfunction of the sensor would be indicated, so that preserved food would not be affected by the malfunction. By replacing the malfunctioning sensor the case may be repaired. For this purpose a defrost-completion sensor installed inside the evaporator of said case may be used as said another sensor.

Also, the temperature control method according to the invention for the low-temperature foods preserving case comprises sequential cooling and defrosting operations governed by a timer and ON-OFF temperature control of the compressor based on the comparison of the temperature of the cooling evaporator with the temperature detected by a temperature control sensor, and is characterized by:

means for controlling the temperature based on the average, under normal conditions, of the two temperature control sensors positioned one at an outlet and another at an inlet for the cooling air;

means for finding the malfunction if any of the two temperature control sensors; and means for controlling the temperature based on the output of a normal temperature control sensor in the event of malfunction of either of the two sensors detected.

With this constitution having a duplicate detector system a reliable temperature control method for the low-temperature foods preserving case is obtained.

Also, the temperature control method according to the invention for the low-temperature foods preserving case comprises control of sequential refigeration and defrosting governed by a timer and ON-OFF temperature control of the compressor based on the comparison of the temperature of the cooling evaporator with the temperature detected by at least one temperature control sensor, and is characterized by: a compressor that is sequentially turned ON and OFF based on the comparison of the detected signal from said sensor with preset upper-and lower-limit temperature signal; memory means that updates its memory with at least one of the newest ON and OFF periods of the compressor; means for finding malfunction of the temperature sensor; control means for switching the duty period of the compressor, based on the output of this malfunction finding means, from the current duty period to the one recalled from said memory means.

With this constitution, since the duty ON or OFF period has been stored just before a malfunction, the compressor may be operated by recalling the stored duty ON or OFF period in the event of sensor malfunction. As a result practically normal and optimum temperature control may be realized, under the current ambient temperature at that time.

In this case the memory means preferably memorizes the mean value of the ON and OFF periods.

In the above duty control the duty ON periods (i.e. periods for supplying refrigerant to the cooling evaporator) are preferably longer than the duty OFF periods (i.e. periods for stopping the evaporator).

Figure 1:
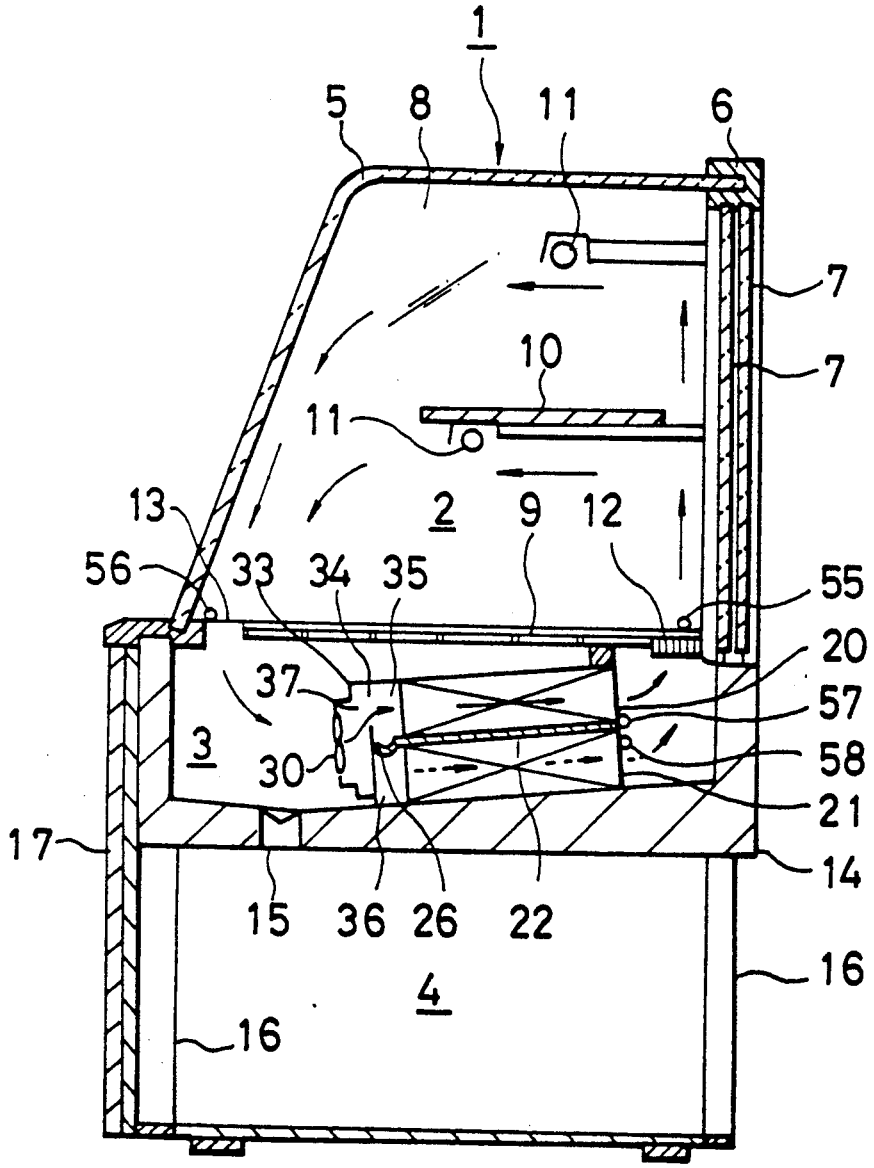
FIG. 1 is a sectional side elevation (A—A of FIG. 2) of a low-temperature foods preserving case embodying the invention.
Figure 2:
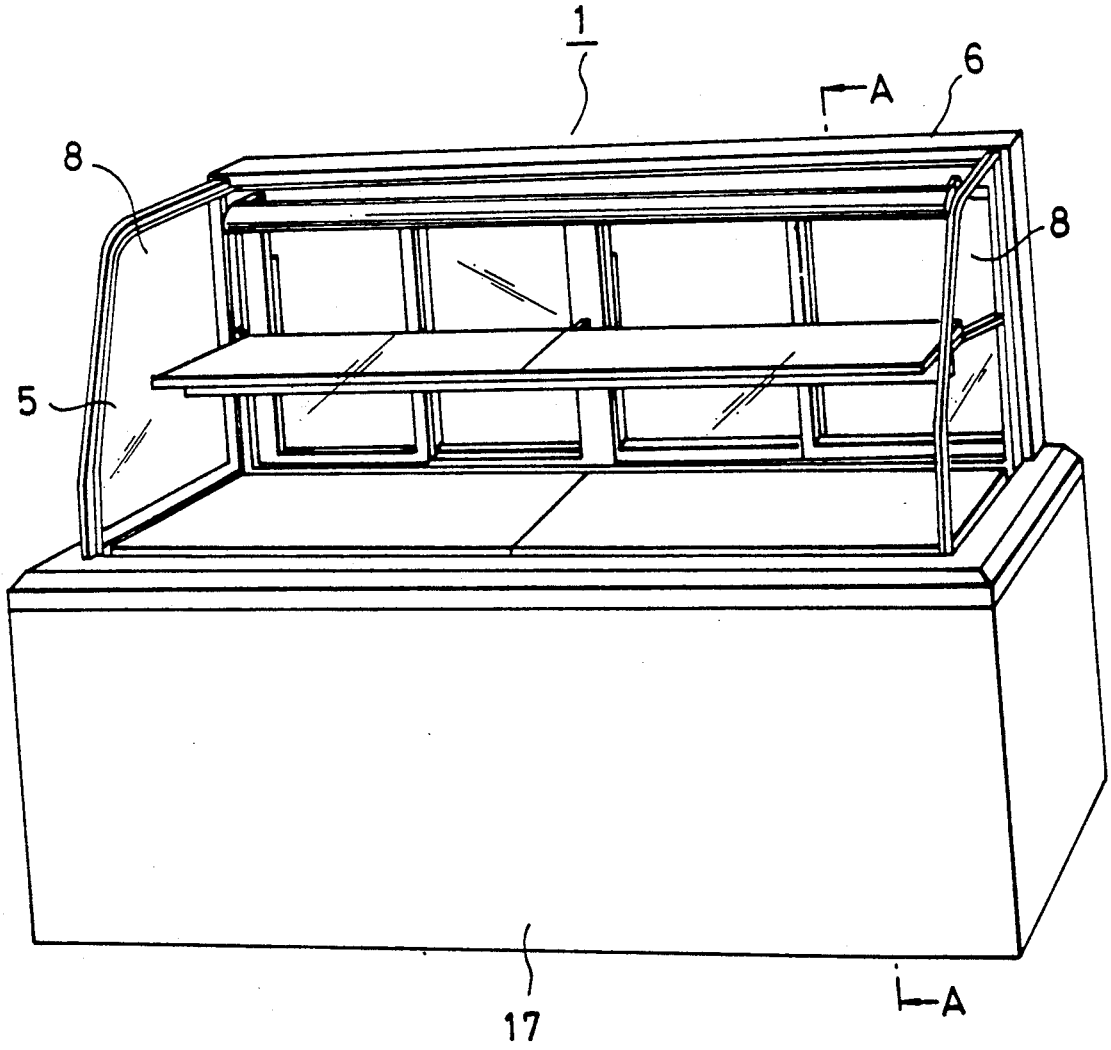
FIG. 2 is an external perspective view of the case.
Figure 3:
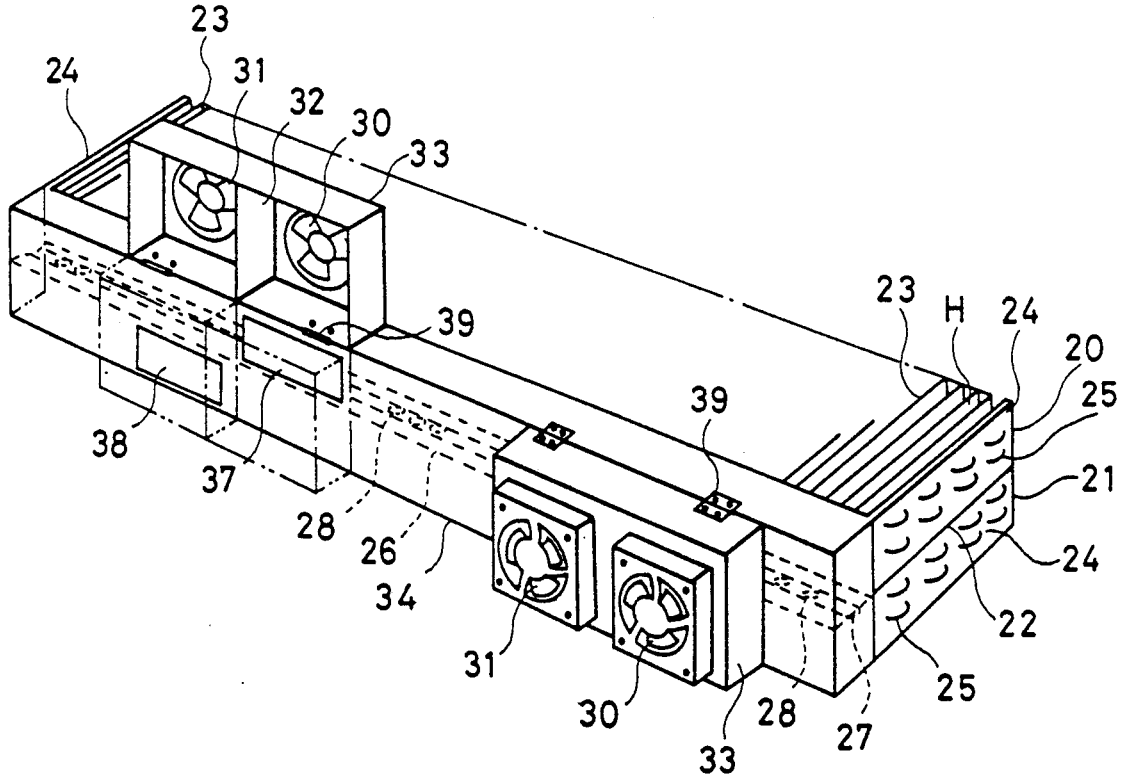
FIG. 3 is a perspective view of a cooling apparatus of the case.

The low-temperature case 1 shown in FIGS. 1 through 3 is of the closed type, suitable for preserving cakes and the like refrigerated. It comprises a preserving chamber 2, a cooling chamber 3 located right beneath the preserving chamber 2, and a machinery room 4 located right beneath the cooling chamber 3. The preserving chamber 2 comprises a bent transparent plate 5 extending from the front to the top of the chamber, a plurality of transparent doors 7 which can slide in contact with each other and in parallel to the right and left inside the frame 6 behind the case, and transparent side panels 8 arranged on the opposite sides of the chamber. Inside the preserving chamber are removable bottom panel 9 which also serves as a partition, a shelf 10, and a fluorescent lamp 11. The bottom panel 9 provides a upper-lower partition between said preserving and cooling chambers 2 and 3, respectively, and are provided with an outlet port 12 on the rear edge and an inlet port 13 on the front edge thereof, through which said preserving and cooling chambers 2 and 3 are communicated. The cooling chamber 3 comprises an thermally insulating wall 14 which opens upwardly for supporting the preserving chamber 2. The machinery room 4 is formed below the thermally insulating wall 14. The thermally insulating wall 14 has a drain port 15 in the bottom wall thereof, and in cooperation with a metal frame 16 constitutes a base 17.

A first and a second evaporators 20 and 21, respectively, are arranged in the cooling chamber 3 such that the first evaporator 20 is located on top of the second evaporator 21 across the dew receiving and partitioning plate 22 so that the first evaporator 20 is located in an inner passage of the cooling air and the second evaporator 21 in an outer passage and slightly inclined downward towards said drain port 15. The first and the second evaporator 20 and 21 are plate-fin type evaporators comprising many equally spaced flat fins 23, a right and a left tube plates 24, and a plurality of refrigerant pipes 25 which cross the fins and the tube plates perpendicularly, as shown in FIG. 3. In order to make easy the evaporation of the defrosted water on the fins 23 by increasing the wet area thereof, the fins are each coated with a film (H) of hydrophilic paint containing desiccating agents such as silica gel, for example Kosmer KP9811B (brand name) manufactured by Kansai Paint Co.

The partitioning plate 22 has a portion 26 extending forward from one end thereof past the air inlet port of the first and the second evaporator 20 and 21 i.e. extending towards a fan described below. This extending portion 26 is formed of a groove 27 for receiving dews from the first evaporator 20 and a plurality of draining holes 28 for dropping the dews in the groove. The draining holes 28 are preferably formed in the region where the wind pressure of the fan described below is weak.

First and second fans 30 and 31, respectively, are continuously run for forced circulation of the cooling air through said first and second evaporator 20 and 21, and through the cooling chamber 3—outlet port 12—preserving chamber 2—inlet port 13—cooling chamber 3 as indicated by the arrow. These fans are both mounted in a fan casing 33 having an intermediate central partitioning plate 32. The first and the second fans 30 and 31 are increased in number when the length of the low-temperature case 1 is long. For example, if the length of the first and the second evaporators 20 and 21 is six feet, two pairs of the fans should be used.

A duct 34 is arranged and fixed on the right and left tube plate 24 with fasteners such as screw spikes so that its rear edge overlaps the upper front edge of said evaporator 20 and the front edges of the right and left tube plates of the first and the second evaporator 20 and 21. Consequently the air inlet ports of the first and the second evaporator 20 and 21 and the extended portion 26 of the partitioning plate 22 are covered with the duct 34. On the other hand the room inside the duct is divided into inner and outer regions or upper and lower regions, by said extending portion 26, forming a first air passage 35 facing the first evaporator 20 and a second air passage 36 facing the second evaporator 21. The duct 34 is for diffusing the cooling air sent from the first and the second fans 30 and 31 to the corresponding evaporators in such a way that the air is diffused evenly across the entire width of the evaporators 20 and 21. For this purpose the duct is provided with a first opening 37 formed at an appropriate position in the upper half portion thereof and facing the first air passage 35, and with a second opening 38 formed at an appropriate position in the lower half portion and facing the second air passage 36, as shown in FIG. 3.

The fan casing 33 is pivotally mounted on the duct 34 by pivotal means 39 such as hinges so that the casing can take an upward or downward position. When disposed at the downward position the first fan 30 is associated with an inner route consisted of the first opening 37, the first air passage 35 and the first evaporator 20. On the other hand the second fan 31 is associated with an outer route consisted of the second opening 38, the second air passage 36 and the second evaporator 31. Thus they deliver the cooling air returning from the preserving chamber 2 to the evaporators 20 and 21.

The fan casing 33 may be lifted from its downward position and located over the duct 34 as shown in FIG. 3 for occasional cleaning of the upper surfaces of the extending portion 26 and the bottom wall of the thermally insulating wall 14 through the first opening 37 or the second opening 38, and for maintenance operations of the first and the second fans 30 and 31. The bottom plate 9 is removed when the fan casing 33 is lifted.

Figure 4:
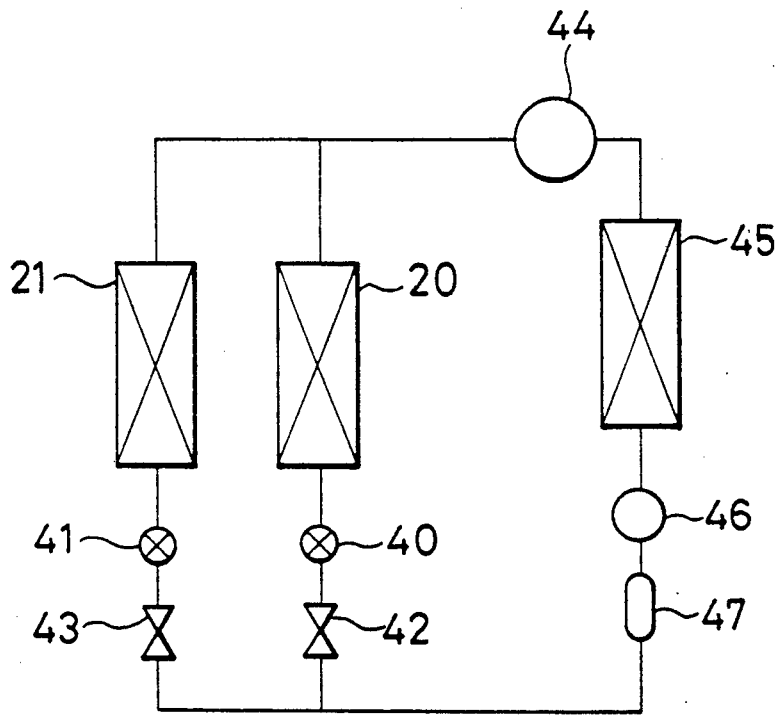
FIG. 4 is a refrigerant circuit of the cooling apparatus.

FIG. 4 shows a refrigerant circuit for the cooling system, in which said first and second evaporators 20 and 21 are connected in parallel with each other but connected in series with a first and a second expansion valve 40 and 41, a first and a second electromagnetic valve 42 and 43, respectively. A refrigerant compressor 44, a condenser 45, a water receiver 46 and a drier 47, along with said first and second evaporator 20 and 21, said first and second expansion valve 40 and 41, said first and second electromagnetic values 42 and 43, form a cooling cycle. To note, the refrigerant compressor 44 and the condenser 45 are accommodated in said machinery room 4.

Figure 5:
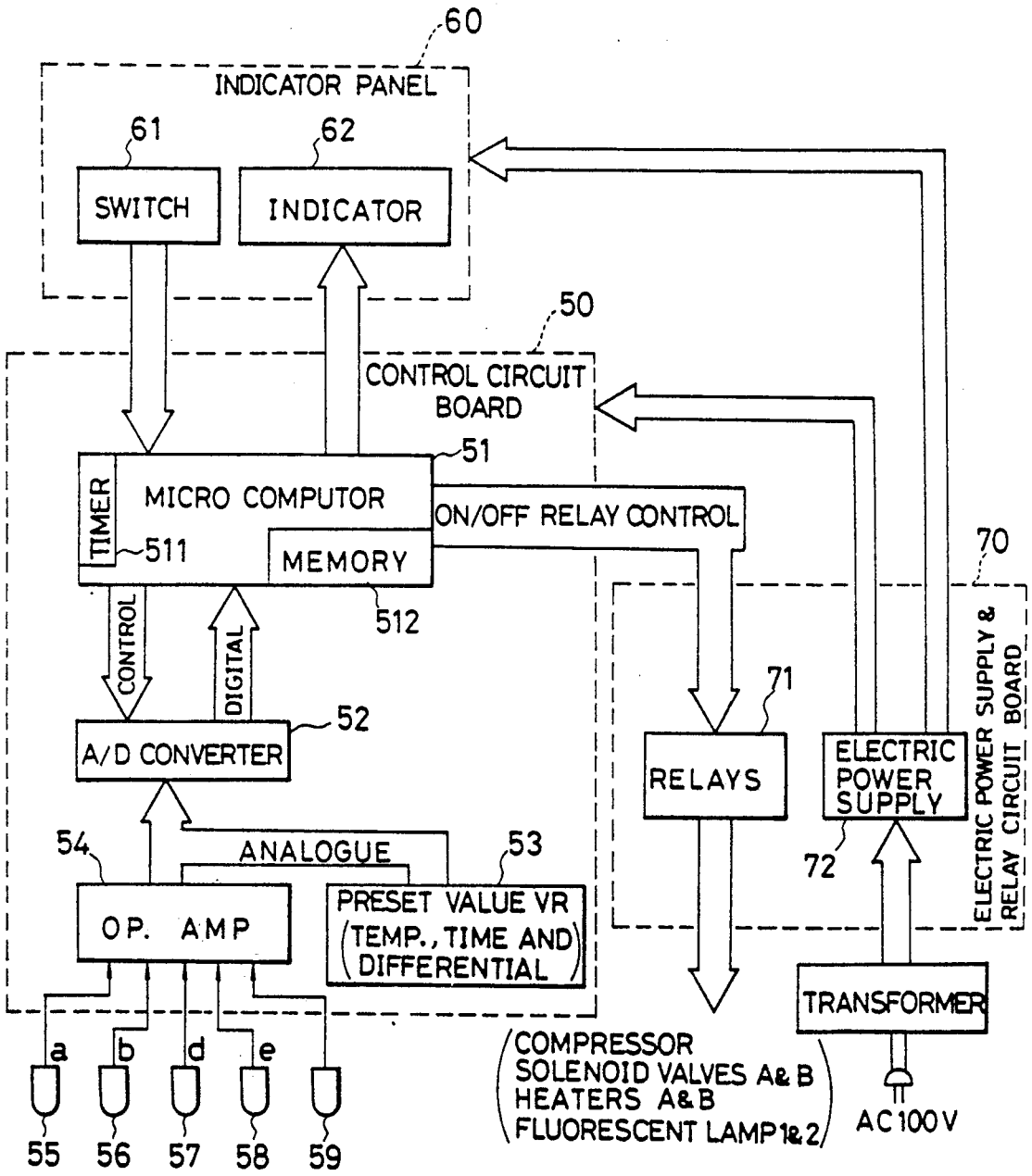
FIG. 5 is a constitution of a control unit of the case.

FIG. 5 shows diagramatically a control unit having a control panel 50, an indicator panel 60, an electric power relay panel 70 and so on required for performing the control of the low-temperature case 1.

On the control panel 50 are installed such components as a microcomputer 51 for various processing operations, an A/D converter 52 for signal conversion, a setting device for setting temperature, time, differentials (to be described below) and the like, and an operational amplifier 54 for amplifying the sensor output. With the operational amplifier 54 are connected various sensors such as a temperature control A sensor (referred to as TC-A sensor) 55, temperature control B sensor (referred to as TC-B sensor) 56, a defrost-completion A sensor 57, a defrost-completion B sensor 58, a filter sensor 59. The TC-A sensor 55 is installed near the cooling air outlet port 12, and TC-B sensor near the cooling air inlet port 13. The defrost-completion A sensor 57 is installed on the first evaporator 20, while the defrost-completion B sensor 58 is installed near the evaporator 21. The filter sensor 59 is installed on the filter of the evaporator 45, and will give an alarming signal as the temperature of the evaporator 45 becomes abnormally high due to the clogging of the filter.

Various switches 61 for inputting various instruction in the microcomputer 51, indicators 62 for indicating the conditions informed by the microcomputer 51 are provided on the indicator panel 60.

The electric power relay panel 70 has thereon relays 71 for making ON or OFF the compressor 44, the first and the second electric valves 42 and 43, fluorescent lamps 11, A and B heaters (not shown in the Figure) in response to the instruction from the microcomputer 51, and an electric power supply line 72 for providing necessary electric power to the components on the control panel 50 and the indicator panel 60. The electric power supply line 72 is in turn connected with an AC 100 V plug through an electric transformer.

Figure 6:
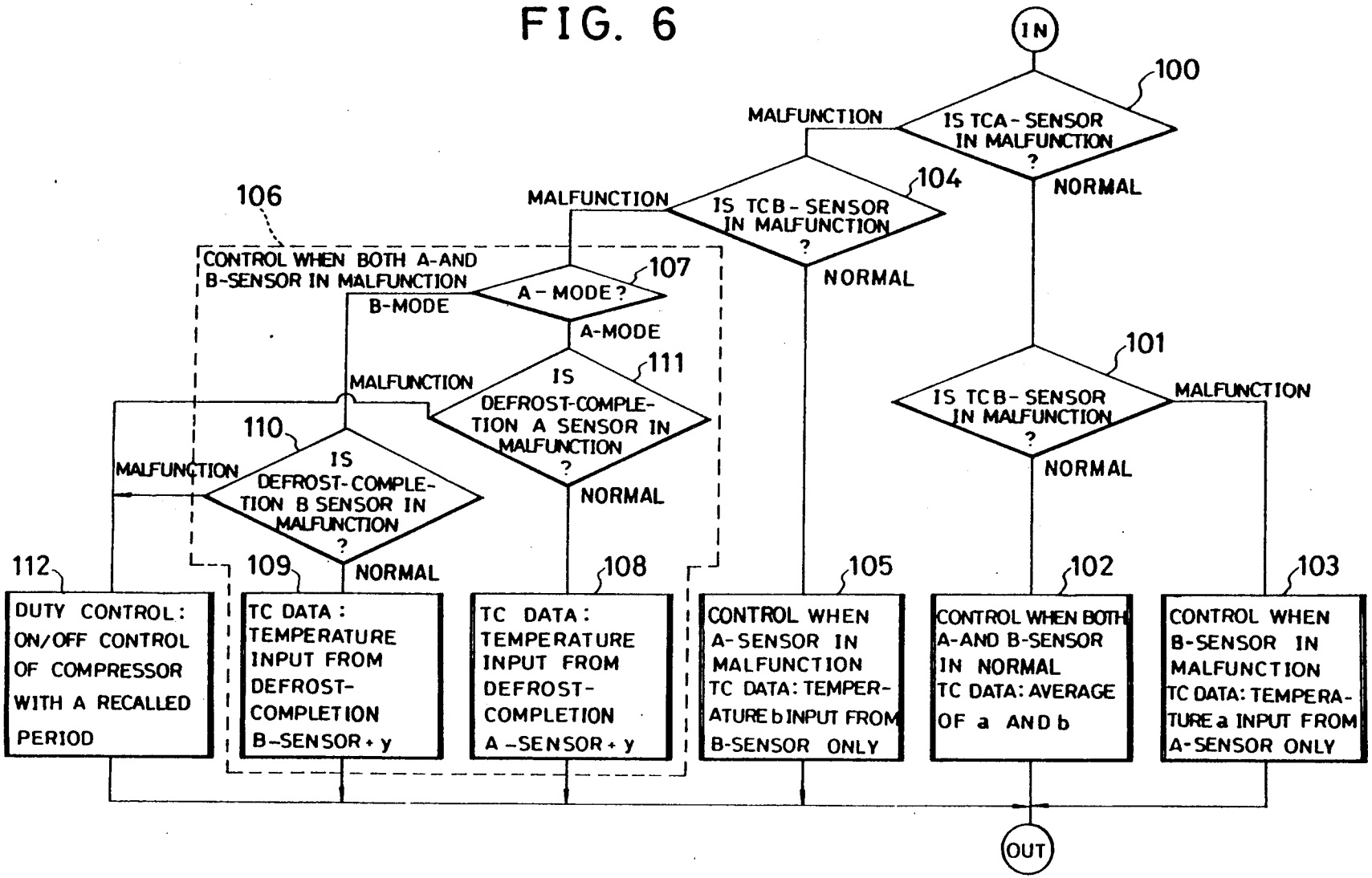
FIG. 6 is a flow-chart of the processes carried out by the microcomputer shown in FIG. 5.
Figure 7:
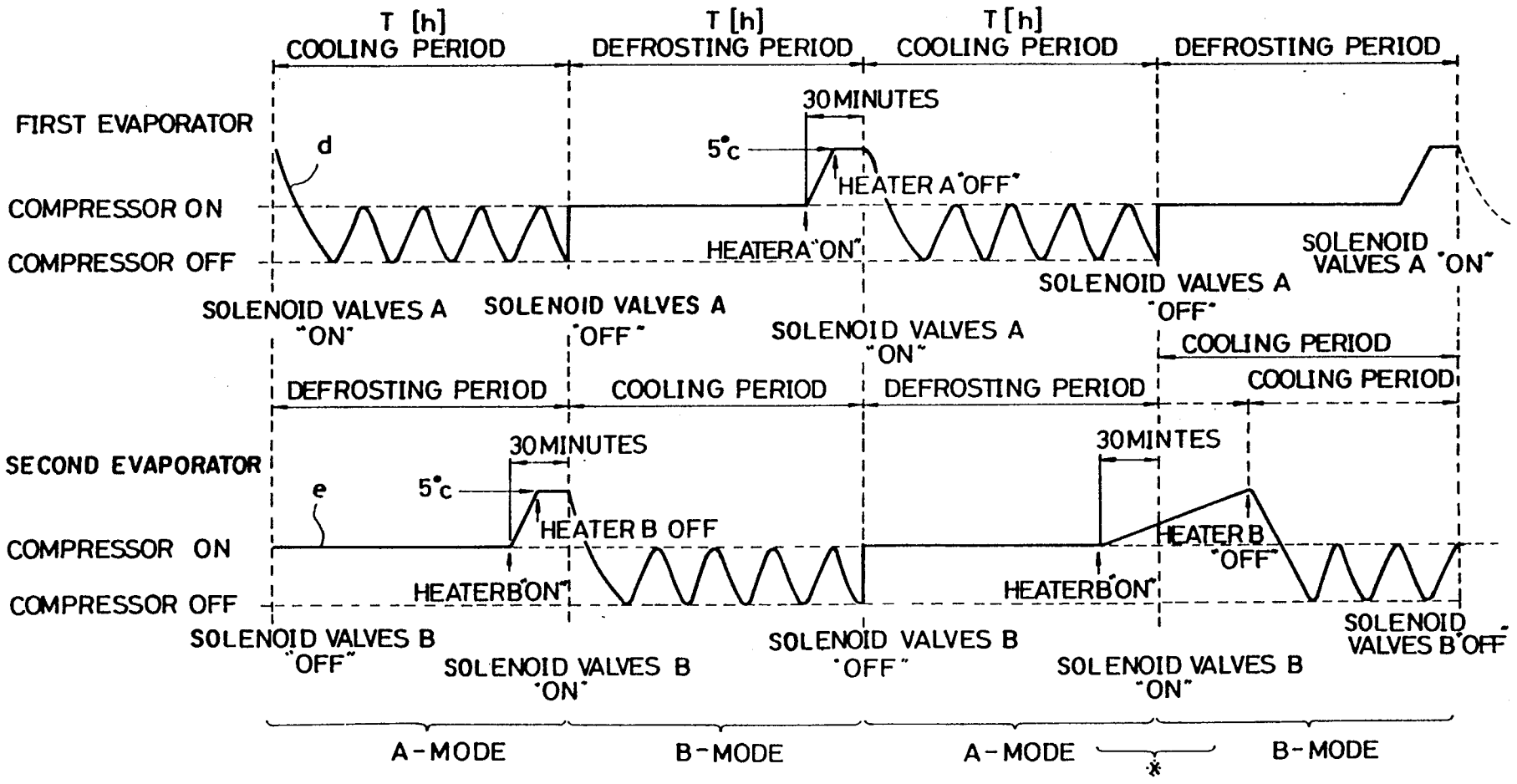
FIG. 7 is a diagram showing the relationships between the operational modes of the two evaporators and the defrost-completion temperature.
Figure 8:
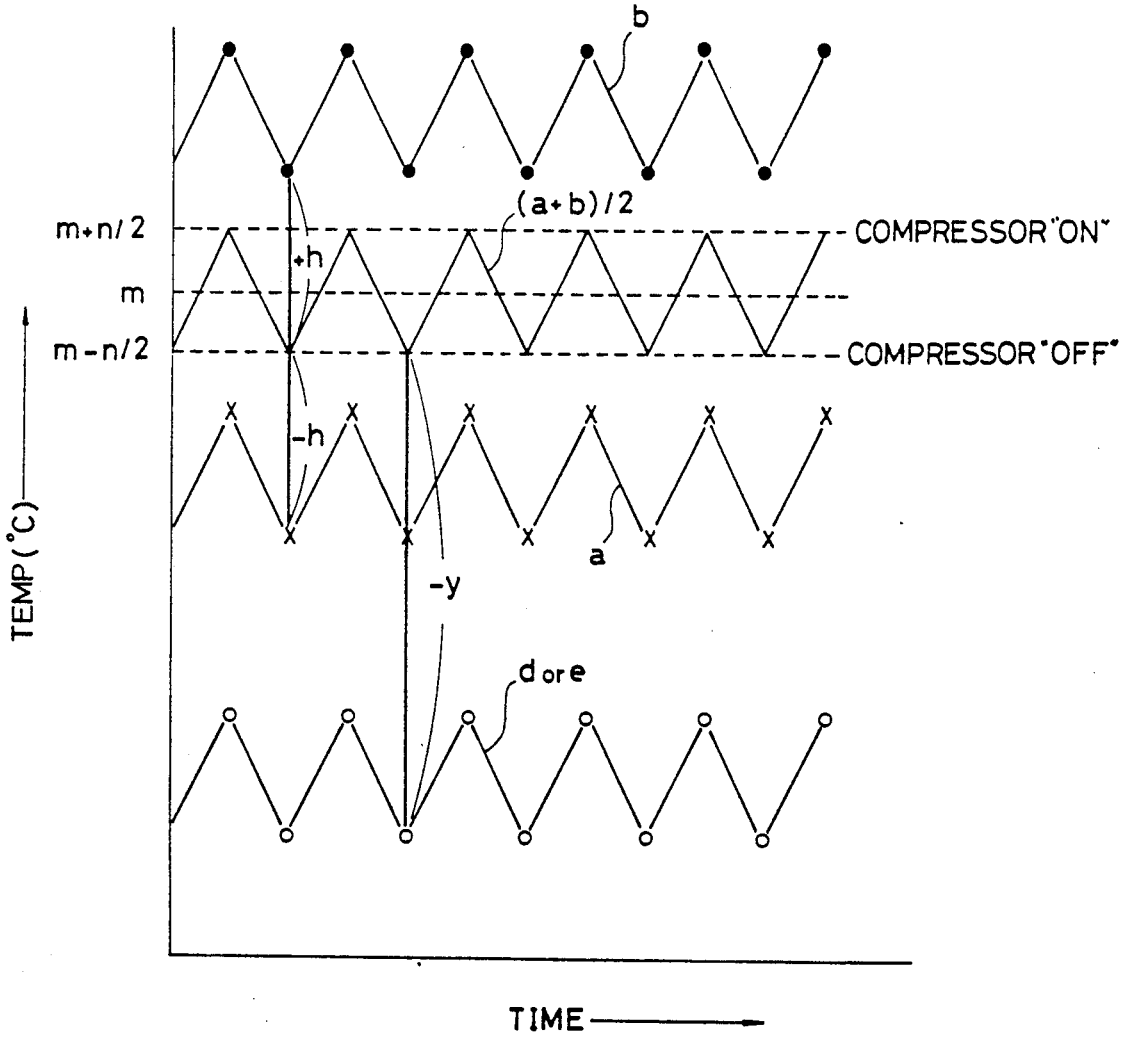
FIG. 8 is an output timing chart for each sensor during the temperature control operations.

Referring to the flow chart and the timing chart shown in FIGS. 6–8 the control operation for the low-temperature case 1 having the above constitution will be now described.

The output of the various sensors 55–59 obtained through the operational amplifier 54 and the preset data in the setting device 53 are fed into the microcomputer 51 after they are converted into HEX data by the A/D converter 52. The microcomputer 51 registers in these data as needed to control cooling, defrosting, alarming, and necessary indications.

In describing the operation of the control unit let us denote by m [°C.] the temperature set in the setting device 53, by n [°C.] the set differential value indicative of the width between the upper and lower limit about said set temperature m, by t [h] the set cycle time, by a [°C.] the temperature input from the TC-A sensor 55, by b [°C.] the temperature input from the TC-B sensor 56, by d [°C.] the temperature input from the defrost-completion A sensor 57, by e [°C.] the temperature input from the defrost-completion B sensor 58.

Firstly, the microcomputer 51 registers input date supplied from the various sensors as shown in FIG. 6 to look for sensor malfunction. When the TC-A sensor and the TC-B sensor are both found to be normally functioning (100, 101), the average (a+b)/2 of the TC data a and b is calculated (103) and the temperature is controlled based on this average.

Since there are two evaporators 20 and 21 in the low-temperature case 1, the microcomputer 51 controls the first and the second evaporators 20 and 21 so that the second evaporator 21 will be defrosting during the cooling operation of the first evaporator 20, as shown in FIG. 7, over the period t [h] (A mode), and over the next period t the evaporator 20 signals defrosting during the cooling operation of the evaporator 21 (B mode), where the period t is the period of the cycle of either mode preset in the setting device 53. Such A and B modes will alternate during the operation.

For the A mode control, the microcomputer 51 outputs to the relays 71 a set of instructions for making the electric valve 42 ON and making the electric valve 43 OFF. The microcomputer 51 further surveys the average (a+b)/2 of the TC data to see if it is in the range between the upper limit m+n/2 and the lower limit m−n/2 about the preset mean value m. Namely, the microcomputer 51 outputs to the relays 71 an instruction for making the refrigerant compressor 44 ON or OFF to keep the average in the range (±n/2) about the mean m. As a result the average (a+b)/2 of the TC data fluctuates up and down according to the ON and OFF of the refrigerant compressor 44, as shown in FIG. 8.

The TC data b and a then periodically vary by ±n in reference to the average (a+b)/2, and the outputs d and e of the defrost-completion sensors similarly vary by −y in reference to its average.

In this way when the two TC sensors 55 and 56 are normal, the cooling compressor 44 is turned ON and OFF so that the average output (a+b)/2 of the sensors are held within the predetermined temperature range. In this case only one of the two evaporators is in cooling operation at a time while the other is in natural defrosting operation blowing the air, delivering the vapor evaporated from the evaporator to give the preserving chamber 2 humidity and prevent the foods from being dried.

The microcomputer 51 supplies to the relays 71 an instruction to turn ON a heater (not shown) installed near the evaporators 20 and 21 30 minutes prior to the end of the A mode. The microcomputer then inspects the output d or e of the defrost-completion sensors, and turns OFF the heater if the output exceeds the return temperature by 5 [°C.]. The microcomputer then examines the residual time of the period, and, if it has exceeded T [h], switches the mode from A to B mode.

If the output of one defrost-completion sensor still remains below the preset return the temperature of the defrosting evaporator within 30 minutes after the mode switching, then the other evaporator will be switched from the cooling operation to the defrosting operation, as indicated by the asterisk * in FIG. 7. Said one evaporator will not be switched to the cooling mode until its defrost-completion sensor output reaches the preset return temperature.

Thus, by turning on the heater of the defrosting evaporator only for a predetermined period of time (30 minutes) prior to switching back to cooling operation, the evaporator undergoes defrosting under the forced air convection by the fan before the heating, permitting the frost to gradually evaporate from the evaporator and give sufficient humidity in the preserving chamber to prevent the foods from being dried. The turning on of the heater ensures the remaining frost which has not been removed by the convection to evaporate and provide good cooling efficiency.

Since the defrosting operation is given a priority over the cooling operation at the time of mode switching, both evaporators will be free of frost as the cooling is started, allowing a high cooling efficiency.

If one of the TC sensors 55 and 56 fails to function during the utilization of the case, the other normal sensor will continue to control the temperature. Namely, as shown in FIG. 6, if the TC-A sensor is normal (100) and the TC-B sensor is malfunctioning (101), then the temperature control may be carried out based on the input data from the TC-A sensor only (103), and if the TC-B sensor is normal (104), the control may be carried out based on the input data from the TC-B sensor only (105). When the control is based on TC-A only, the chamber temperature becomes higher than the normal chamber temperature by h, but when the control is based on the TC-B sensor only, the chamber temperature becomes lower by h. However, this difference h is not so large that it is negligible i.e. the temperature in the chamber can be maintained at about the same as the normal temperature.

When both TC-A and -B sensors malfunction, the defrost-completion sensor of the evaporator is in cooling operation (106). In this case the temperature difference y is fairly large, making the temperature in the chamber higher by y [°C.], which would notably differ from the normal temperature. Therefore, in order to suppress this temperature rise y, the compressor is turned ON as the temperature input d or e+y of the defrost-completion sensor reaches m+n/2, and turned OFF as d lowers to m−n/2. Namely, the microcomputer judges (107) if the operation is in A mode or not, and if so, employ the sum (d+y) obtained by adding y to the output d of the defrost-completion A-sensor (108), as the basis for the temperature control. On the other hand, in B mode, the sum (e+y) obtained by adding y to the output e of the defrost-completion B-sensor e is employed (109) as the basis of the temperature control.

Accordingly, the double sensors above may provide very reliable temperature control and, in the event of the malfunction of one sensor, the other will back up the malfunctioning one to maintain normal temperature control.

In the case where both defrost-completion A and B sensors have become inoperable, this malfunction will be found (110,111) by the diagnosis means in the microcomputer 51, and duty control is switched to the control governed by the timer 511 in the microcomputer 51. This duty control comprises an ON-OFF control of the compressor via the relays 71 by means of the timer 511. This ON-OFF timing may be realized by setting the timer 511 at the latest ON-OFF timing stored in the memory 512 in the microcomputer 51 at the time of the malfunction, the memory being updated with the ON-OFF timing obtained from the comparison of the normal temperature sensor output with the preset upper and lower temperature limits.

Thus, an optimum duty control may be furnished in accordance with the ambient temperature even when all the temperature sensors have failed to function, thereby accurately keeping the temperature inside the case constant.

It is thus possible with these control means to maintain the chamber temperature constant.

On the other hand the chamber temperature indicated on the indicators 62 under normal operating condition is (a+b)/2. As one of the TC sensors 55 and 56 fail to function, the malfunction of the sensor is indicated, with the correct temperature indicated based on the reading by the other correct sensor. Further, when both of the TC sensors 55 and 56 fail to fuction, only the malfunction is indicated. The Table below summarizes the operations described above.

TABLE 1

| | TC Data | Compressor "ON" | Compressor "OFF" | Indication |
|---|---|---|---|---|
| Sensors in normal condition | (a + b)/2 | | | Chamber temperature |
| TC sensor A in malfunction | b | m + n/2 | m − n/2 | Sensor malfunction & temperature (b) |
| TC sensor A in malfunction | a | | | Sensor malfunction & temperature (a) |
| TC sensors A & B in malfunction | d + y (A mode) / e + y (B mode) | | | only Sensor malfunction |
| Malfunction of all sensors | | t1 | t2 | only Sensor malfunction |

t1 and t2 are times.

It should be noted that, although the example described above has only two evaporators, the number of the evaporators is not limited to two.

It would be obvious that the temperature sensors and defrosting completion sensors may be arbitrary in number. Therefore it would be obvious from the above example that in a design where only one temperature control sensor is installed it would be readily substituted for by the defrost-completion sensor as it becomes inoperable, and, when all the sensors have become inoperable, the compressor would be run with a predetermined period as a consequence of the duty control for such occasions.

We claim:

1. A low-temperature foods preserving case for preserving foods in a closed foods preserving chamber having a door on one side thereof, comprising means for alternately performing cooling and defrosting operations for periods of time in response to output of a timer; said alternately performing means including first and second evaporators arranged in the cooling chamber of the case and connected in parallel for alternately repeating performance of the cooling and defrosting operations;

a partition panel arranged between said first and second evaporators for partitioning said cooling chamber to sections associated with corresponding evaporators;

fans arranged in said cooling chamber in association with said first and second evaporators for forcibly circulating the air through the foods preserving chamber and the cooling chamber, said fans being kept in continuous running operation for providing constant humidity so that the fan associated with the evaporator that is performing the cooling operation provides the foods preserving chamber with cooled air and the fan associated with the evaporator that is performing the defrosting operation provides the cooling chamber with humid air.

2. A low-temperature foods preserving case according to claim 1, further comprising:

heating means for heating said evaporators:

temperature control means for bringing said heating means in operation to establish a heated defrosting operation that follows an air defrosting operation of the evaporator and for prohibiting the evaporator, depending on the detection signal from a defrost-completion sensor of the evaporator, from resuming cooling by prolonging a defrosting period until the evaporator completes the defrosting operation.

3. A low-temperature foods preserving case according to claim 1, wherein said plurality of evaporators are coated with hydrophilic paint on the surfaces to enhance water adhesion thereon.

4. A low-temperature foods preserving case according to claim 2, wherein said plurality of evaporators are coated with hydrophilic paint on the surfaces to enhance water adhesion thereon.

5. A low-temperature foods preserving case according to claim 2, wherein said fans are each arranged in association with corresponding evaporators and run all the time.

6. A temperature control arrangement for a low-temperature foods preserving case comprising means for performing alternate cooling and defrosting operations governed by the output of a timer;

ON-OFF control means for controlling operation of a compressor based on a comparison of the signal output from a temperature control sensor with the signals indicative of preset upper and lower temperature limits and also based on detection signals from defrost-completion sensors for detecting the completion of defrosting;

means for finding a malfunction of the temperature control sensors;

means for providing temperature control in event of said malfunction based on the detection signal obtained from another normally operating defrost-completion sensor in the case; and means for indicating the malfunction of the temperature control sensors.

7. A temperature control arrangement for a low-temperature foods preserving case according to claim 6, wherein said another temperature sensor in the case is a defrost-completion sensor for the evaporator.

8. A temperature control arrangement for a low-temperature foods preserving case, the arrangement comprising means for performing cooling and defrosting operations governed by the output of a timer, ON-OFF control means for controlling operation of a compressor based on the comparison of the signal output from a temperature control sensor with the signals indicative of preset upper and lower temperature limits;

means for controlling the temperature which is, under normal conditions, based on the average of at least two temperature control sensors positioned one at an outlet and another at an inlet port for the cooling air of said case;

means for finding the malfunction, if any, of the two temperature control sensors; and means for controlling the temperature based on the output of a normal temperature control sensor in the case of malfunction of either of the two sensors detected.

9. A temperature control arrangement for a low-temperature foods preserving case, comprising means for performing cooling and defrosting operations governed by the output of a timer;

ON-OFF control means for controlling operation of a compressor based on the comparison of the temperature detected by a temperature control sensor with preset upper and lower temperature limits;

the compressor that is alternately turned ON and OFF based on the comparison of the signal output from said sensor with the signals indicative of preset upper and lower temperature limits;

memory means that updates memory with the latest duty period of at least one of ON- and OFF-cycles of the compressor;

means for finding malfunction of the temperature sensors; and control means for switching the operation of the compressor, based on the signal output from said means for finding the malfunction, from the ON-OFF control to a duty control having the duty cycle period stored in said memory means.

10. A temperature control arrangement for a low-temperature foods preserving case according to claim 9, wherein said memory means stores the latest average of the ON periods and the latest average of the OFF periods of the compressor.

11. A temperature control arrangement for a low-temperature foods preserving case according to claim 9, wherein the ON-OFF control means has ON periods of said duty cycles that are set longer than the OFF periods.

* * * * *